US005799341A

United States Patent [19]

Rodas

[11] Patent Number: 5,799,341

[45] Date of Patent: Sep. 1, 1998

[54] COMBINATION TOILET AND BIDET SYSTEM

[76] Inventor: Jaime E. Rodas, 8635 SW. 20th Ter., Miami, Fla. 33155

[21] Appl. No.: 801,435

[22] Filed: Feb. 18, 1997

[51] Int. Cl.[6] ..... A47K 3/20

[52] U.S. Cl. ..... 4/420.4; 4/448

[58] Field of Search ..... 4/420.4, 420.5, 4/447, 448

[56] References Cited

U.S. PATENT DOCUMENTS

| | | | |
|---|---|---|---|
| 280,017 | 6/1883 | Dutton | 4/420.5 X |
| 4,094,018 | 6/1978 | Bemthin | 4/420.4 |
| 5,142,711 | 9/1992 | Parikh | 4/420.4 |
| 5,319,811 | 6/1994 | Hauri | 4/420.4 |

FOREIGN PATENT DOCUMENTS

| | | | |
|---|---|---|---|
| 2142054 | 1/1985 | United Kingdom | 4/420.4 |

*Primary Examiner*—Robert M. Fetsuga

[57] ABSTRACT

A combination toilet and bidet system including a compact bidet assembly secured to a rear portion of a seat portion of a toilet disposed between the seat portion and a tank portion thereof. The bidet is coupled with a water supply tube of the toilet.

2 Claims, 4 Drawing Sheets

FIG 3
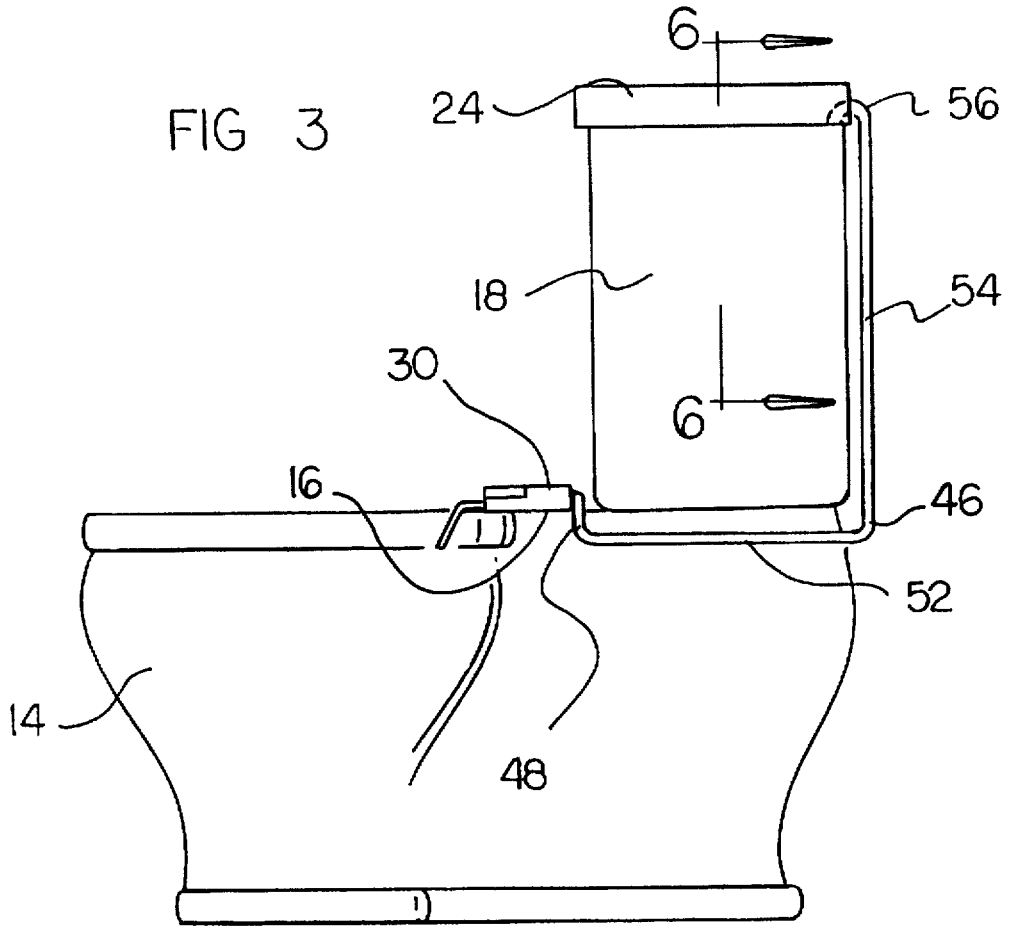
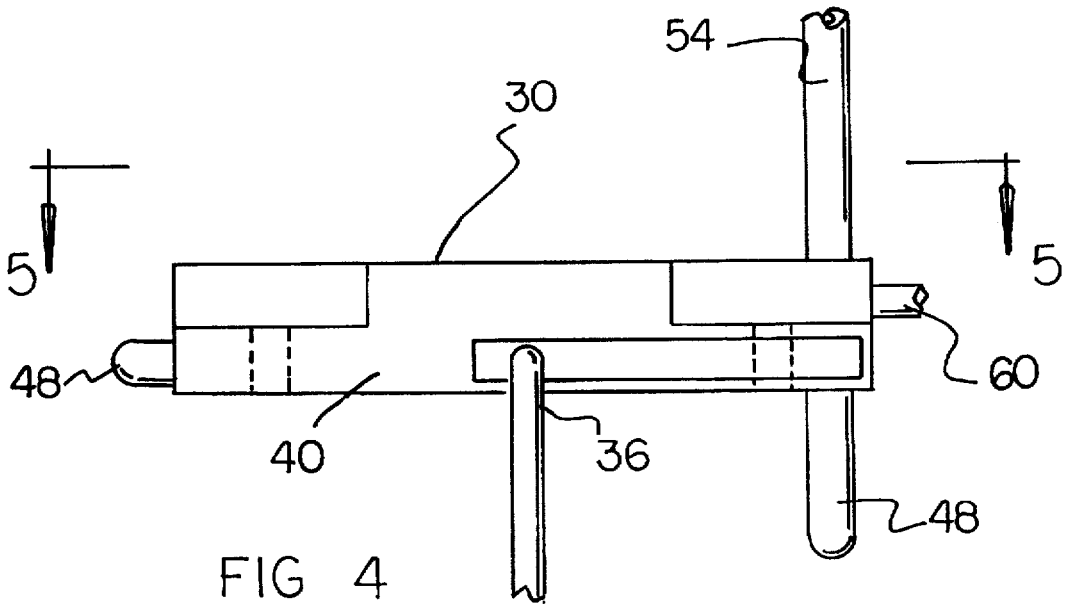
FIG 4

COMBINATION TOILET AND BIDET SYSTEM

BACKGROUND OF THE INVENTION

1. Field of the Invention

The present invention relates to a combination toilet and bidet system and more particularly pertains to incorporating a bidet into a toilet for cleaning a user's private parts with a combination toilet and bidet system.

2. Description of the Prior Art

The use of toilet bidets is known in the prior art. More specifically, toilet bidets heretofore devised and utilized for the purpose of connecting a bidet to a standard toilet are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,279,001 to Vento discloses a toilet seat bidet assembly.

U.S. Pat. No. 5,384,919 to Smith discloses a toilet seat supported bidet.

U.S. Pat. No. Des. 329,492 to New disclose the ornamental design for a combined bidet, toilet seat, and toilet seat cover.

U.S. Pat. No. 5,409,167 to Borod discloses a hygienic spray apparatus.

U.S. Pat. No. 5,331,692 to Alberti discloses a spray apparatus for use on a toilet seat.

U.S. Pat. No. 5,271,104 to LaTora discloses a toilet bidet.

While these devices fulfill their respective, particular objective and requirements, the aforementioned patents do not describe a combination toilet and bidet system for incorporating a bidet into a toilet for cleaning a user's private parts.

In this respect, the combination toilet and bidet system according to the present invention substantially departs from the conventional concepts and designs of the prior art, and in doing so provides an apparatus primarily developed for the purpose of incorporating a bidet into a toilet for cleaning a user's private parts.

Therefore, it can be appreciated that there exists a continuing need for new and improved combination toilet and bidet system which can be used for incorporating a bidet into a toilet for cleaning a user's private parts. In this regard, the present invention substantially fulfills this need.

SUMMARY OF THE INVENTION

In the view of the foregoing disadvantages inherent in the known types of toilet bidets now present in the prior art, the present invention provides an improved combination toilet and bidet system. As such, the general purpose of the present invention, which will be described subsequently in greater detail, is to provide a new and improved combination toilet and bidet system and method which has all the advantages of the prior art and none of the disadvantages.

To attain this, the present invention essentially comprises a toilet including a seat portion. The seat portion has a rear portion extending rearwardly therefrom. The toilet has a tank portion secured to the rear portion of the seat portion. The tank portion has a plurality of components therein. One of the components includes a water supply tube. The tank portion has a lid removably disposed over an open upper end thereof. The device includes a compact bidet assembly comprised of a housing. The housing has a generally rectangular configuration. The housing is secured to the rear portion of the seat portion disposed between the seat portion and the tank portion. The housing has an L-shaped tube disposed therein. The bidet assembly includes front tubing. The front tubing has a horizontal tube and a vertical tube. The horizontal tube is integral with a forward end of the L-shaped tube and extends outwardly of a front wall of the housing. The horizontal tube extends along the rear portion of the seat portion of the toilet. The vertical tube is integral with and extends downwardly from the horizontal tube into the seat portion of the toilet. An angular tube extends from a free end of the vertical tube. A spray nozzle is secured to a free end of the angular tube. The bidet assembly includes rear tubing. The rear tubing includes a first segment that is integral with a rearward end of the L-shaped tube and extends outwardly of a lower wall of the housing. A second segment of the rear tubing is integral with a free end of the first segment and extends beneath a bottom of the tank portion of the toilet. A third segment of the rear tubing is integral with a free end of the second segment and extends upwardly along a rear wall of the tank portion of the toilet. A fourth segment of rear tubing is integral with a free end of the third segment. The fourth segment extends under the lid of the tank portion of the toilet to couple with the water supply tube therein. The device includes a handle assembly comprised of an elongated slidable rod extending inwardly of a side of the housing. An outer end of the slidable rod has a round handle disposed thereon. An inner end of the slidable rod has a bracket pivotally coupled thereto. A middle portion of the bracket has downwardly extending teeth thereon. A free end of the bracket is pivotally coupled with the interior housing. The handle assembly includes a gear having an axle extending within the interior housing and secured to the horizontal tube. The gear is positioned outwardly of the interior housing and disposed below and engaged to the teeth of the bracket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved combination toilet and bidet system which has all the advantages of the prior art toilet bidets and none of the disadvantages.

It is another object of the present invention to provide a new and improved combination toilet and bidet system which may be easily and efficiently manufactured and marketed.

It is a further object of the present invention to provide a new and improved combination toilet and bidet system which is of durable and reliable construction.

An even further object of the present invention is to provide a new and improved combination toilet and bidet system which is susceptible of a low cost of manufacture with regard to both materials and labor, and which accordingly is then susceptible of low prices of sale to the consuming public, thereby making such a combination toilet and bidet system economically available to the buying public.

Even still another object of the present invention is to provide a new and improved combination toilet and bidet system for incorporating a bidet into a toilet for cleaning a user's private parts.

Lastly, it is an object of the present invention to provide a new and improved combination toilet and bidet system including a compact bidet assembly secured to a rear portion of a seat portion of a toilet disposed between the seat portion and a tank portion thereof. The bidet is coupled with a water supply tube of the toilet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation view of the present invention.

FIG. 4 is a front view of the housing of the bidet of the present invention.

The same reference numerals refer to the same parts through the various Figures.

DESCRIPTION OF THE PREFERRED EMBODIMENT

Figure 1:
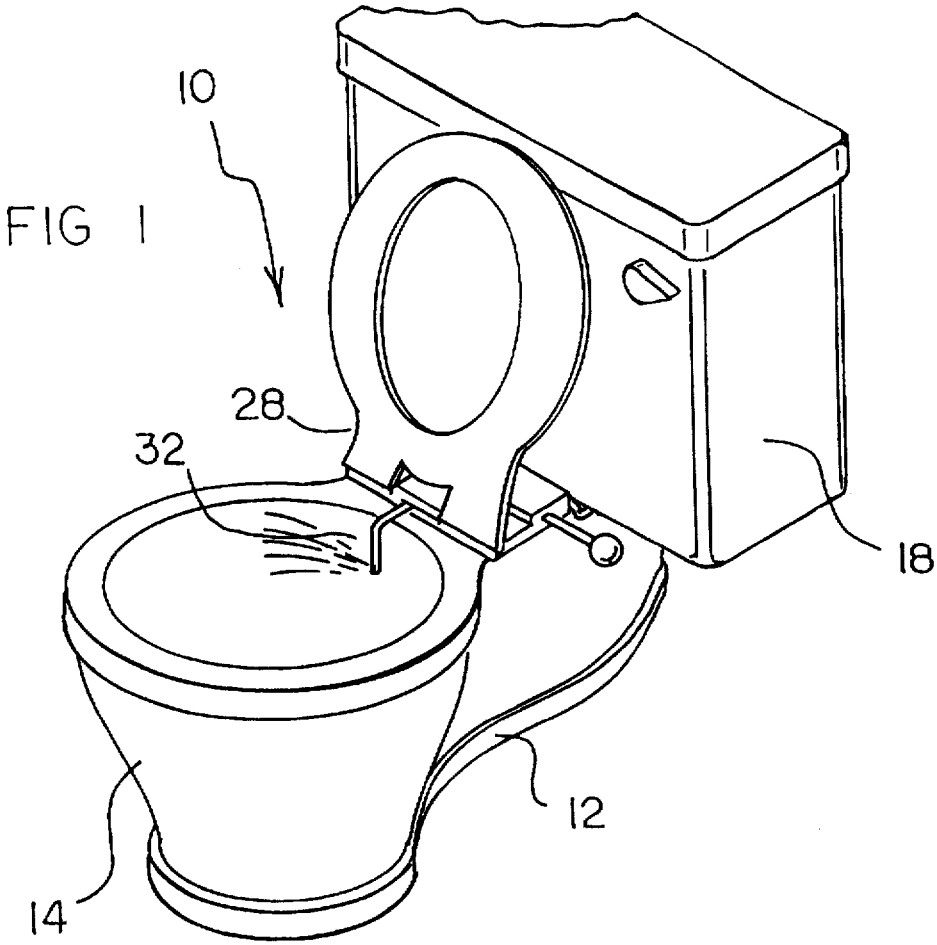
FIG. 1 is a perspective view of the preferred embodiment of the combination toilet and bidet system constructed in accordance with the principles of the present invention.
Figure 2:
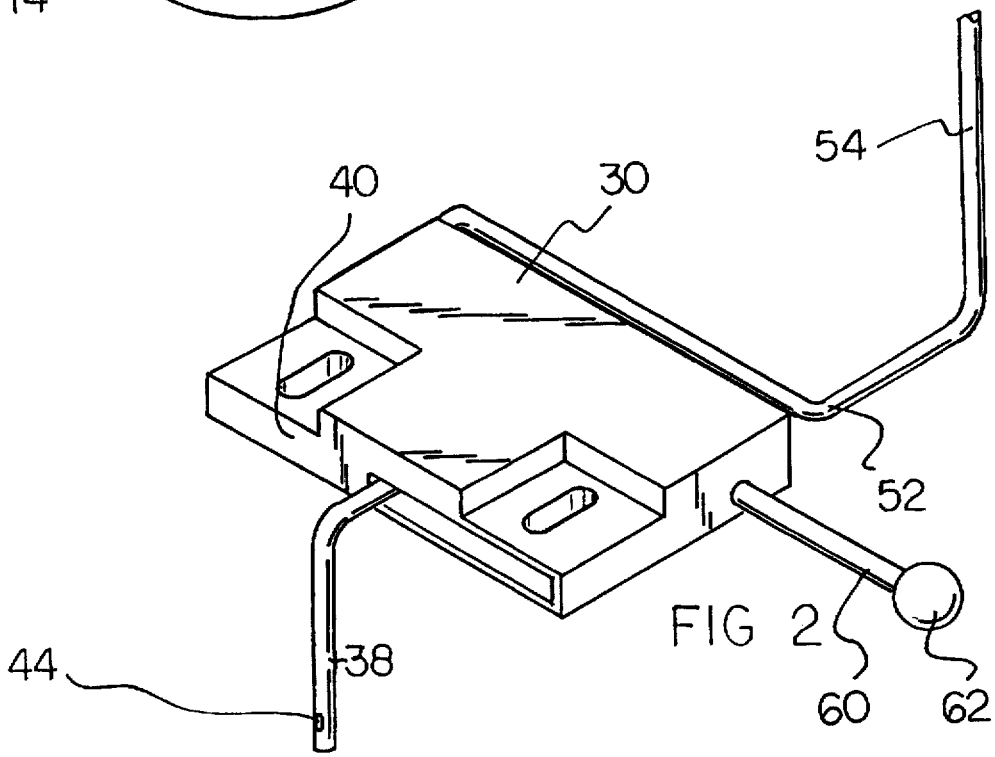
FIG. 2 is a perspective view of the housing and front and rear tubing of the bidet.
Figure 5:
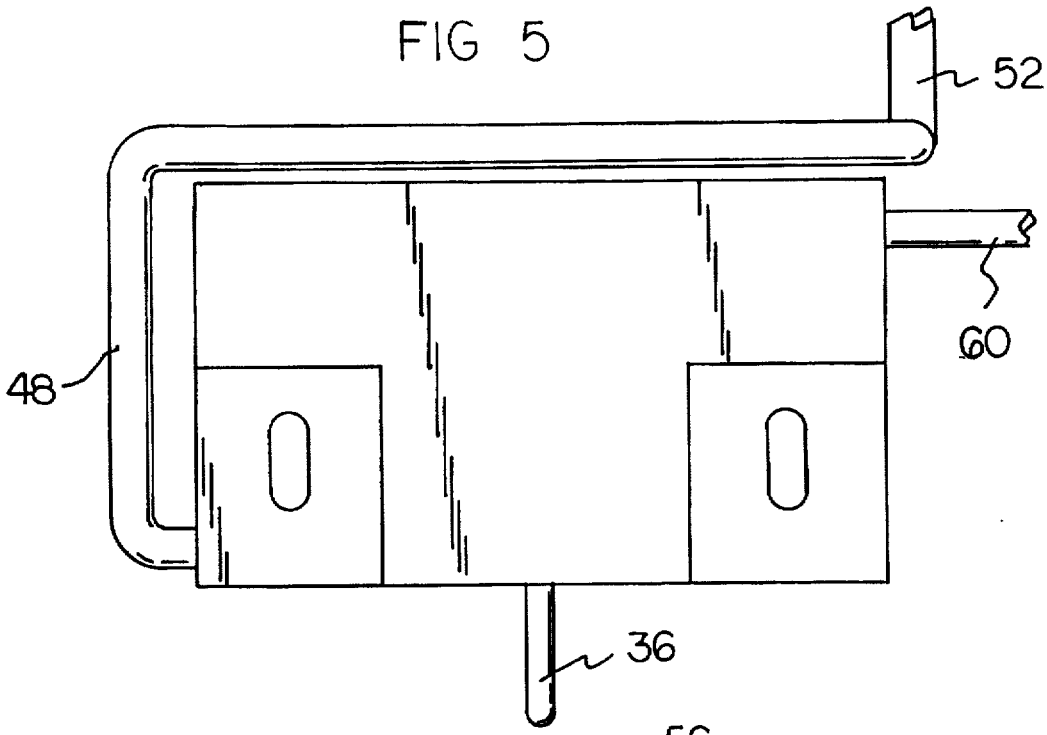
FIG. 5 is a cross-sectional view as taken along line 4—4 of FIG. 4.
Figure 6:
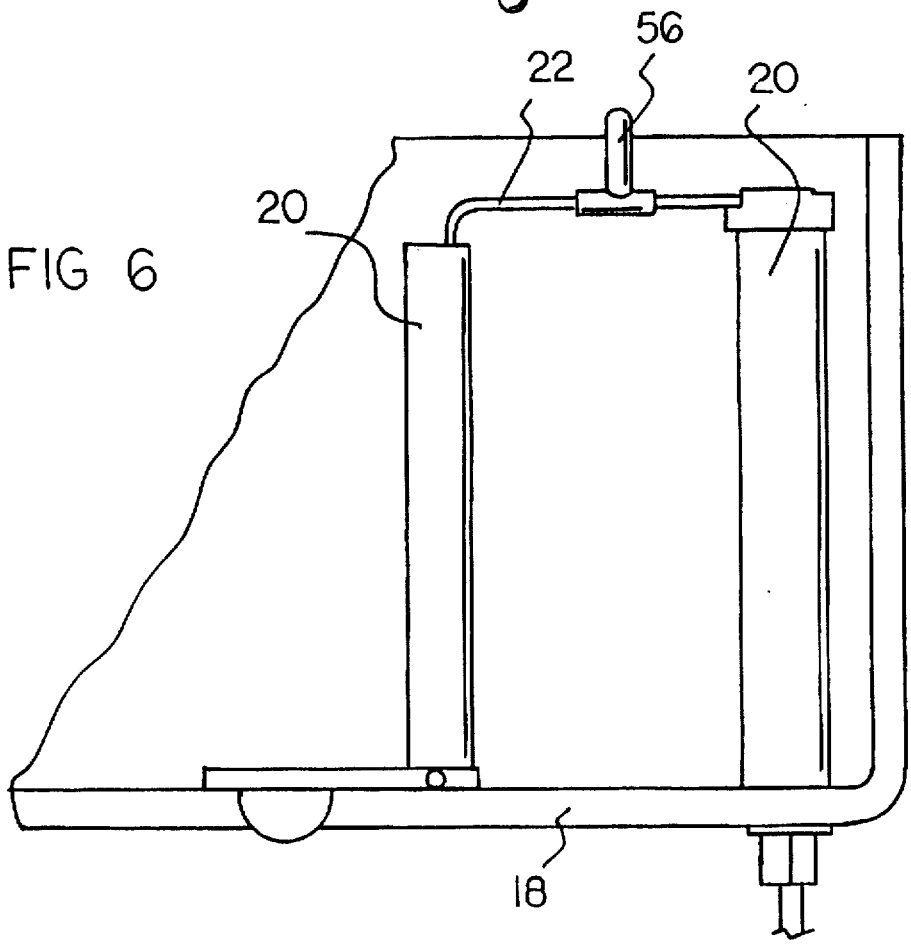
FIG. 6 is a cross-sectional view as taken along line 6—6 of FIG. 3.
Figure 7:
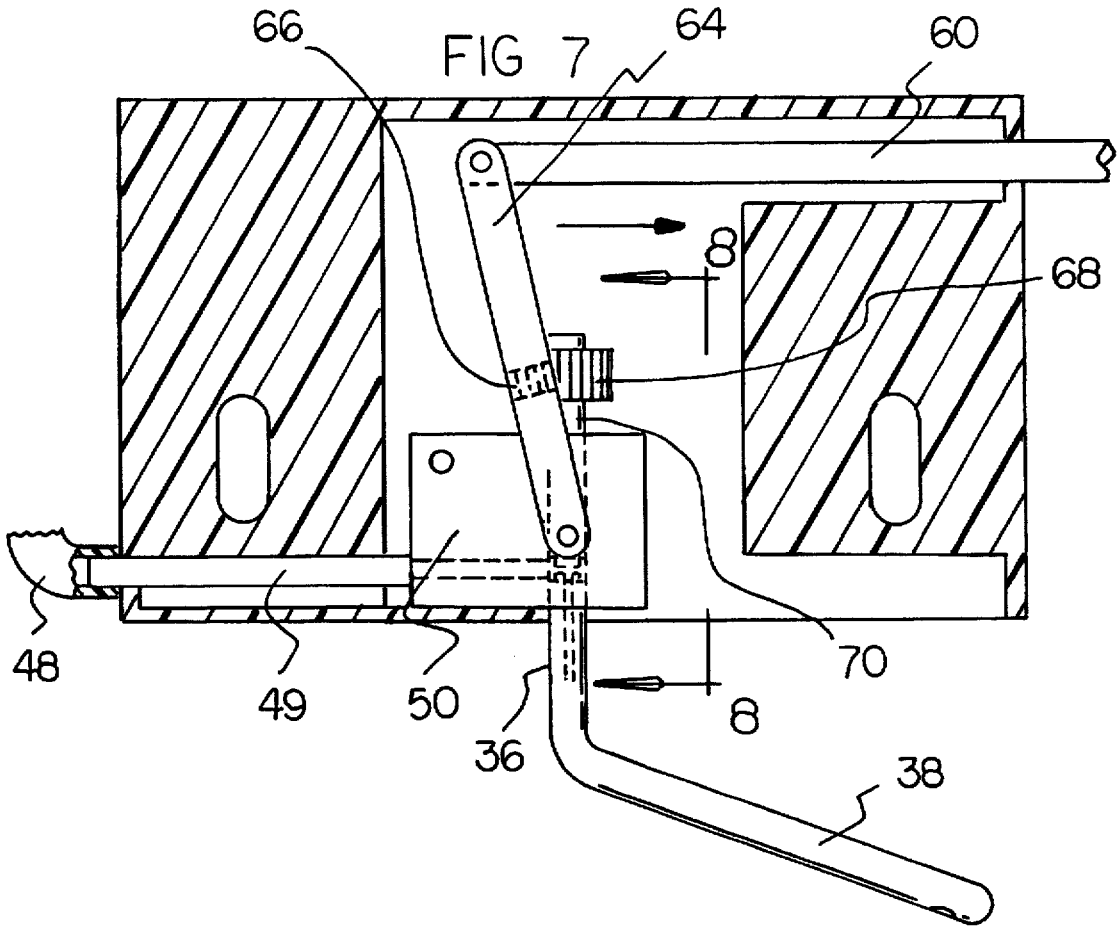
FIG. 7 is a top plan view of the bidet shown in cross-section.
Figure 8:
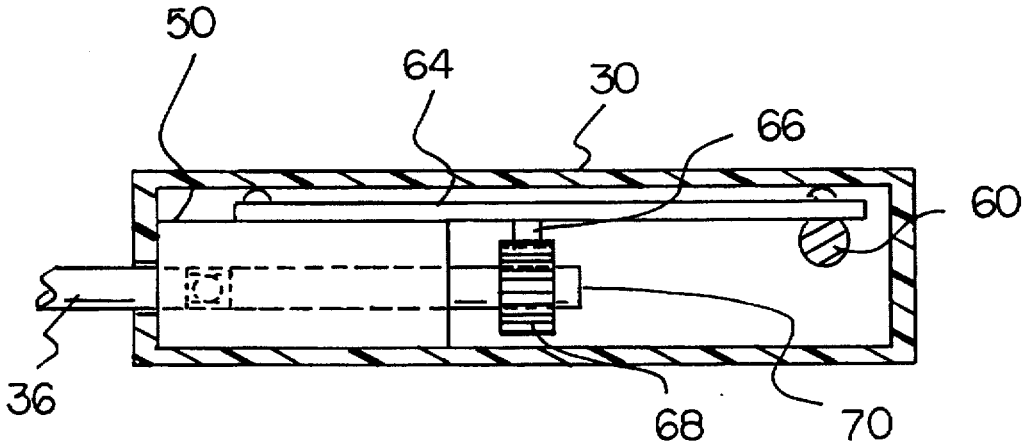
FIG. 8 is a cross-sectional view as taken along line 8—8 of FIG. 7.

With reference now to the drawings, and in particular, to FIGS. 1–8 thereof, the preferred embodiment of the new and improved combination toilet and bidet system embodying the principles and concepts of the present invention and generally designated by the reference number 10 will be described.

Specifically, it will be noted in the various Figures that the device relates to a combination toilet and bidet system for incorporating a bidet into a toilet for cleaning a user's private parts. In its broadest context, the device consists of a toilet and a compact bidet assembly. Such components are individually configured and correlated with respect to each other so as to attain the desired objective.

The device 10 consists of a low profile, plastic housing 30 that could be installed between a rear end of a seat 14 and a tank 18 of a typical toilet 12. Extending from a center of the housing's 30 front surface would be a short horizontal section of rigid tubing 36. The tubing has a dispensing aperture 44 for the outward spraying of water that would redirect the flow of water upward and forward.

Extending through the housing 30 would be a flexible, transparent rear tubing 46. This tubing 46 would be routed back under the tank portion 18, up its right, rear side and under the lid 24. An end of this tubing would be connected to an overflow filler tube or other water supply fitting 22. This would enable the device 10 to provide a steady stream of water during and immediately after the toilet 12 is flushed.

The toilet 12 of the device 10 includes a seat portion 14. The seat portion 14 has a rear portion 16 extending rearwardly therefrom. The toilet 12 has a tank portion 18 secured to the rear portion 16 of the seat portion 14. The tank portion 18 has a plurality of working components 20 therein. One of the components includes a water supply tube 22. The tank portion 18 has a lid 24 removably disposed over an open upper end thereof. The toilet 12 is of a standard configuration known in the industry. The size of the toilet 12 used will not effect the use of the device 10.

The device 10 includes a compact bidet assembly 28 comprised of a housing 30. The housing 30 has a generally rectangular configuration. The housing 30 is secured to the rear portion 16 of the seat portion 14 disposed between the seat portion 14 and the tank portion 18. The housing 30 has an L-shaped tube outlet tube 32. The L-shaped outlet tube includes a horizontal tube 36 and a vertical tube 38. The horizontal tube 36 extends outwardly of a front wall 40 of the housing 30. The horizontal tube 36 extends along the rear portion 16 of the seat portion 14 of the toilet 12. The vertical tube 38 is integral with and extends downwardly from the horizontal tube 36 into the seat portion 14 of the toilet 12 to a positioned beneath a rim of the seat portion 14. A lower end of the vertical tube has a dispensing aperture 44 therein. The bidet assembly 28 includes rear tubing 46. The rear tubing 46 includes a first segment 48 having an interior portion 49 disposed within the housing and coupled with a rearward end of the horizontal tube within an interior housing 50 and an inner portion that extends outwardly of a side wall of the housing 30 and extends around a rear of the housing. A second segment 52 of the rear tubing 46 is integral with a free end of the first segment 48 and extends beneath a bottom of the tank portion 18 of the toilet 12. A third segment 54 of the rear tubing 46 is integral with a free end of the second segment 52 and extends upwardly along a rear wall of the tank portion 18 of the toilet 12. A fourth segment 56 of rear tubing 46 is integral with a free end of the third segment 54. The fourth segment 56 extends under the lid 24 of the tank portion 18 of the toilet 12 to couple with the water supply tube 22 therein.

Lastly, the device 10 includes a handle assembly comprised of an elongated slidable rod 60 extending inwardly of a side of the housing. An outer end of the slidable rod has a round handle 62 disposed thereon. An inner end of the slidable rod has a bracket 64 pivotally coupled thereto. A middle portion of the bracket has downwardly extending teeth 66 thereon. A free end of the bracket is pivotally coupled with the interior housing 50. The handle assembly includes a gear 68 having an axle 70 extending within the interior housing 50 and secured to the horizontal tube. The gear is positioned outwardly of the interior housing and disposed below and engaged to the teeth 66 of the bracket 64. The handle assembly serves to raise or lower the vertical tube and also serves to hide all tubing with respect to the housing and the toilet. By pulling outwardly on the slidable rod, the vertical tube will be in a down position for use. Alternately, pushing inwardly on the sidable rod will orient the vertical tube in an upward position.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A combination toilet and bidet system for incorporating a bidet into a toilet for cleaning a user's private parts comprising, in combination:

said toilet comprised of a seat portion, the seat portion having a rear portion extending rearwardly therefrom, the toilet having a tank portion secured to the rear portion of the seat portion, the tank portion having a plurality of components therein, one of the components including a water supply tube, the tank portion having a lid removably disposed over an open upper end thereof;

a compact bidet assembly comprised of a housing, the housing having a generally rectangular configuration, the housing secured to the rear portion of the seat portion disposed between the seat portion and the tank portion, the housing having an L-shaped outlet tube rotatably coupled with respect thereto, the L-shaped outlet tube including a horizontal tube and a vertical tube, the horizontal tube extending outwardly of a front wall of the housing, the horizontal tube extending along the rear portion of the seat portion of the toilet, the vertical tube integral with and extending downwardly from the horizontal tube into the seat portion of the toilet, a lower end of the vertical tube having a dispensing aperture therein, the bidet assembly including rear tubing, the rear tubing including a first segment having an interior portion disposed within the housing and coupled with a rearward end of the horizontal tube within an interior housing and an inner portion extending outwardly of a side wall of the housing and extending around a rear of the housing, a second segment of the rear tubing integral with a free end of the first segment and extending beneath a bottom of the tank portion of the toilet, a third segment of the rear tubing integral with a free end of the second segment and extending upwardly along a rear wall of the tank portion of the toilet, a fourth segment of rear tubing integral with a free end of the third segment, the fourth segment extending under the lid of the tank portion of the toilet to couple with the water supply tube therein; and a handle assembly comprised of an elongated slidable rod extending inwardly of a side of the housing, an outer end of the slidable rod having a round handle disposed thereon, an inner end of the slidable rod having a bracket pivotally coupled thereto, a middle portion of the bracket having downwardly extending teeth thereon, a free end of the bracket pivotally coupled with the interior housing, the handle assembly including a gear having an axle extending within the interior housing and secured to the horizontal tube, the gear positioned outwardly of the interior housing and disposed below and engaged to the teeth of the bracket.

2. A bidet system for incorporating a bidet into a toilet for cleaning a user's private parts comprising, in combination:

a compact bidet assembly secured to a rear portion of a seat portion of the toilet disposed between the seat portion and a tank portion thereof, the bidet coupled with a water supply tube of the toilet;

said toilet comprised of a seat portion, the seat portion having a rear portion extending rearwardly therefrom, the toilet having a tank portion secured to the rear portion of the seat portion, the tank portion having a plurality of components therein, one of the components including a water supply tube, the tank portion having a lid removably disposed over an open upper end thereof;

wherein the compact bidet assembly is comprised of a housing, the housing having a generally rectangular configuration, the housing secured to the rear portion of the seat portion;

wherein the housing has an L-shaped outlet tube disposed therein;

wherein the outlet tube has a horizontal tube and a vertical tube, the horizontal tube extending outwardly of a front wall of the housing, the horizontal tube extending along the rear portion of the seat portion of the toilet, the vertical tube integral with and extending downwardly from the horizontal tube into the seat portion of the toilet, a lower end of the vertical tube having a dispensing aperture therein;

wherein the bidet assembly includes rear tubing coupled between the L-shaped outlet tube and the water supply tube of the toilet;

wherein the rear tubing includes a first segment having an interior portion disposed within the housing and coupled with a rearward end of the horizontal tube within an interior housing and an inner portion extending outwardly of a side wall of the housing and extending around a rear of the housing, a second segment of the rear tubing integral with a free end of the first segment and extending beneath a bottom of the tank portion of the toilet, a third segment of the rear tubing integral with a free end of the second segment and extending upwardly along a rear wall of the tank portion of the toilet, a fourth segment of rear tubing integral with a free end of the third segment, the fourth segment extending under the lid of the tank portion of the toilet to couple with the water supply tube therein; and a handle assembly comprised of an elongated slidable rod extending inwardly of a side of the housing, an outer end of the slidable rod having a round handle disposed thereon, an inner end of the slidable rod having a bracket pivotally coupled thereto, a middle portion of the bracket having downwardly extending teeth thereon, a free end of the bracket pivotally coupled with the interior housing, the handle assembly including a gear having an axle extending within the interior housing and secured to the horizontal tube, the gear positioned outwardly of the interior housing and disposed below and engaged to the teeth of the bracket.

* * * * *